US006985797B2

(12) United States Patent
Spano, Jr. et al.

(10) Patent No.: US 6,985,797 B2
(45) Date of Patent: Jan. 10, 2006

(54) METHOD OF OPERATING A DISPENSING CABINET

(75) Inventors: Philip H. Spano, Jr., McKees Rocks, PA (US); Robert B. Meek, Jr., Pittsburgh, PA (US)

(73) Assignee: McKesson Automation, Inc., Pittsburgh, PA (US)

( * ) Notice: Subject to any disclaimer, the term of this patent is extended or adjusted under 35 U.S.C. 154(b) by 0 days.

(21) Appl. No.: 10/706,832

(22) Filed: Nov. 12, 2003

(65) Prior Publication Data

US 2004/0098166 A1 May 20, 2004

Related U.S. Application Data

(62) Division of application No. 10/010,387, filed on Dec. 7, 2001, now Pat. No. 6,895,304.

(51) Int. Cl.
*G07F 17/00* (2006.01)

(52) U.S. Cl. ..... 700/237; 700/216

(58) Field of Classification Search ..... 700/237, 700/216

See application file for complete search history.

(56) References Cited

U.S. PATENT DOCUMENTS 4,783,740 A * 11/1988 Ishizawa et al. ..... 705/28
4,847,764 A * 7/1989 Halvorson ..... 700/231
5,330,062 A * 7/1994 Murphree ..... 211/122
5,346,297 A 9/1994 Colson, Jr. et al.
5,377,864 A * 1/1995 Blechl et al. ..... 221/2
5,408,443 A * 4/1995 Weinberger ..... 368/10
5,520,450 A 5/1996 Colson, Jr. et al.
5,564,803 A * 10/1996 McDonald et al. ..... 312/215
5,646,912 A * 7/1997 Cousin ..... 368/10
5,745,366 A * 4/1998 Higham et al. ..... 700/242
5,752,235 A * 5/1998 Kehr et al. ..... 705/3
5,805,455 A * 9/1998 Lipps ..... 700/231
5,805,456 A 9/1998 Higham et al.
5,880,443 A * 3/1999 McDonald et al. ..... 235/375
5,883,806 A * 3/1999 Meador et al. ..... 700/244
5,905,653 A 5/1999 Higham et al.
5,905,654 A * 5/1999 Tanino et al. ..... 716/9
6,011,999 A 1/2000 Holmes
6,151,536 A * 11/2000 Arnold et al. ..... 700/237
6,636,780 B1 * 10/2003 Haitin et al. ..... 700/236
6,648,153 B2 * 11/2003 Holmes ..... 211/85.15
6,682,156 B2 * 1/2004 Herrington ..... 312/215
6,873,881 B1 * 3/2005 Schneible, Sr. ..... 700/216
6,876,902 B2 * 4/2005 Nikolich ..... 700/242
2002/0027507 A1 * 3/2002 Yarin et al. ..... 340/573.1

* cited by examiner

*Primary Examiner*—Donald P. Walsh
*Assistant Examiner*—Michael E Butler
(74) *Attorney, Agent, or Firm*—Thorp Reed & Armstrong, LLP

(57) ABSTRACT

A method of operating a dispensing cabinet to identify the locations where items to be dispensed are located is comprised of a login step in which user information is entered into a processor controlling the dispensing cabinet. The processor unlocks certain doors of the dispensing cabinet in response to the user information. Assuming that a locate mode of operation has been chosen, the locations of the items to be located are determined by the processor. An alpha-numeric display positioned on a shelf within the cabinet begins flashing with the number of items to be located that are held by that shelf. After the user identifies the shelves having flashing alpha-numeric displays, the user may enter a dispense mode or may logoff causing the unlocked doors to lock.

7 Claims, 5 Drawing Sheets

METHOD OF OPERATING A DISPENSING CABINET

CROSS-REFERENCE TO RELATED APPLICATIONS

The present invention is a divisional of U.S. application Ser. No. 10/010,387 entitled "Method of Operating a Dispensing Cabinet" filed 7 Dec. 2001 now U.S. Pat. No. 6,895,304 and having common ownership.

BACKGROUND OF THE INVENTION

1. Field of the Invention

The present invention relates to methods for dispensing items and more particularly, to methods of dispensing medications and supplies from a medication/medical supply cabinet.

2. Description of the Background

A wide variety of systems are used in medical facilities for the dispensing and inventory of medications and medical supplies. For example, U.S. Pat. No. 5,520,450 discloses a supply station with an internal computer. The supply station is comprised of a cabinet having a plurality of lockable doors. Information is provided to a computer which unlocks the doors causing the doors to open slightly. To aid the user in selecting the appropriate compartment, the information input to the computer may be used to not only cause the appropriate door to unlock for opening, but also a lamp or lamps in the compartment where the dispensable items are stored may be illuminated. The computer may be used to simultaneously and automatically update a patient's record, billing information and hospital inventory. The relevant data may be displayed on a display or printed on a sheet of paper by a printer connected to the computer.

U.S. Pat. No. 5,346,297 is directed to an auxiliary storage and dispensing unit. The auxiliary storage and dispensing unit is for use with a computer controlled supply and medication dispensing station. The unit comprises a tall cabinet defining an interior cavity accessible through a front opening. The front opening is accessed through one or more doors whose size and location along the front of the cabinet may be varied. The doors may be joined together to provide access to larger portions of the interior cavity in the case of large items stored therein. The doors remain locked until opened under the control of a computer within the supply and medication dispensing station to which the auxiliary storage and dispensing unit is attached.

U.S. Pat. No. 5,805,455 is directed to methods for dispensing items. The '455 patent discloses a dispensing unit comprised of a plurality of locations in which items are held, a processor in which records corresponding to the items are stored, and a plurality of item switches corresponding to the locations in which the items are held. The item switches are connected to the processor so that a user of the dispensing unit can input records of items removed from the unit into the processor. Preferred embodiments include a plurality of visual indicators, typically in the form of light emitting diodes, corresponding to the locations in which the items are held. On selection of a desired item from a list of items held by the unit, the visual indicator corresponding to the item is actuated so that the user can locate the desired item quickly and conveniently with the help of the visual indicator.

U.S. Pat. No. 5,805,456 discloses improved methods and apparatus for providing access to items to be dispensed and for maintaining an inventory of the items. According to one aspect of the invention, a dispensing unit is provided having an enclosure with an interior. A plurality of storage locations are distributed over a surface of the enclosure. Sensors associated with at least some of the individual storage locations are provided. The unit further includes a multiplicity of receptacles disposed within at least some of the storage locations. Sensors associated with at least some of the individual receptacles are provided. A processor is disposed on the enclosure and connected to receive signals from the storage location-associated sensors and the receptacle-associated sensors.

U.S. Pat. No. 5,905,653 is directed to methods and devices for dispensing pharmaceuticals and medical supply items from a dispensing unit. The dispensing unit is comprised of a processor and a cabinet having a plurality of drawers which are lockable within the cabinet by a locking mechanism. The drawers include a plurality of bins for holding the pharmaceutical or medical supply items. The processor includes a record of the items held within each drawer and which items may be accessed by specific users or user types. According to the method, user identification information is entered into the processor to identify a user that is requesting access to one of the pharmaceutical or medical supply items held in the dispensing unit. The processor then determines which drawer or drawers may be unlocked for access by the user by comparing the user identification information with the record of which items may be accessed by specific users. A signal is sent from the processor to unlock at least one of the drawers to which the user may have access. Touch sensitive buttons disposed on the drawers may be used to indicate removal of items.

U.S. Pat. No. 5,745,366 is directed to improved methods and apparatus for providing access to items to be dispensed and for maintaining an inventory of the items. According to one aspect of the invention, a dispensing unit is provided having an enclosure with an interior. A plurality of storage locations in the form of retractable drawers are provided. Sensors associated with at least some of the individual storage locations are provided. Information about the user and the item to be dispensed may be used to determine the drawers to which the user may have access.

While the prior art illustrates a variety of apparatus and methods for controlling the dispensing of medications and/or medical supplies, the need exists for an improved method of identifying to users of dispensing devices where various items to be dispensed are located. The prior art typically relies upon the illumination of an LED, which may be difficult to spot in a large bank of cabinets or may be overlooked if there is more than one LED on any particular drawer or compartment. Thus, the need exists for improved methods of identifying locations within a dispensing device where desired items may be located.

SUMMARY OF THE PRESENT INVENTION

The present invention is directed to a method of operating a dispensing cabinet to identify the locations where items to be dispensed are located. The method is comprised of a login step in which user information is entered into a processor controlling the dispensing cabinet. The processor unlocks certain doors of the dispensing cabinet in response to the entered user information and stored user information. Assuming that a locate mode of operation has been chosen, the user enters identifying information for the items to be located. Using the entered information and certain stored information, the locations of the items to be located are determined by the processor. An alpha-numeric display positioned on a shelf within the cabinet begins flashing with the number of items to be located that are held by that shelf. After the user identifies the shelves having flashing alpha-numeric displays, the user may enter a dispense mode or may logoff causing the unlocked doors to lock.

The dispense mode may be entered from the locate mode by identifying the compartment having the item to be dispensed by, for example, activating a touch sensitive switch. The flashing alpha-numeric display is continuously lit to display the value "0". The quantity of items to be dispensed can be removed from the compartment and a keypad used to input the quantity of items dispensed. The quantity of items dispensed may be displayed on the alpha-numeric display. When all of the items have been located or located and dispensed, the user may logoff.

The present invention provides a substantial visual indication of the shelf carrying the desired item to be located through the flashing alpha-numeric display. Additionally, the dispense mode may be entered after an item is located which is the same as the normal dispense mode such that the user need not learn two different modes of dispensing depending on how the dispensing mode was entered. Those, and other advantages and benefits will become apparent from the Description of the Preferred Embodiments herein below.

BRIEF DESCRIPTION OF THE DRAWINGS

For the present invention to be easily understood and readily practiced, preferred embodiments will now be described, for purposes of illustration and not limitation, in connection with the following figures in which.

DETAILED DESCRIPTION OF THE PREFERRED EMBODIMENTS

Figure 1:
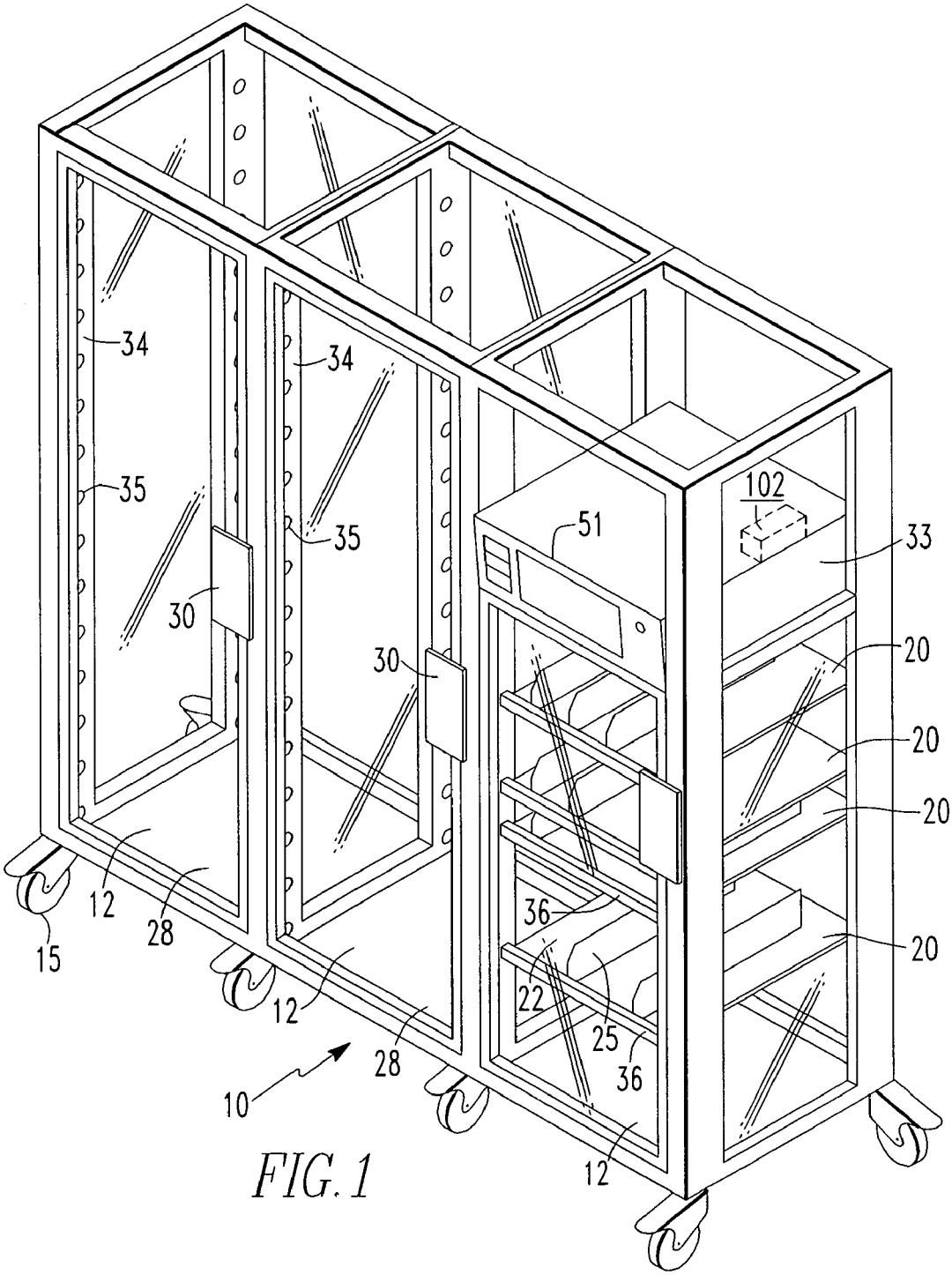
FIG. 1 illustrates a dispensing unit of the type on which the methods of the present invention may be practiced.
Figure 2A:
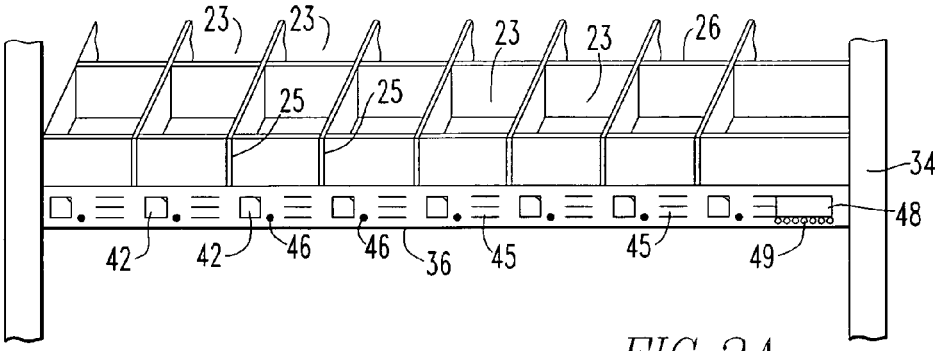
FIGS. 2A and 2B provide a front view of a switch panel at the front of a shelf on which compartments for holding items are defined by a plurality of movable dividers.

FIG. 1 illustrates a dispensing unit 10 of the type on which the methods of the present invention may be practiced. Although the dispensing unit 10 is discussed in an environment in which medications and/or medical supplies are dispensed, other types of items may be dispensed. As shown in FIG. 1, the dispensing unit 10 is comprised of several (usually three to five) vertical cabinets 12 each optionally having wheels or casters 15. The cabinets 12 are divided by a number of shelves 20. Each shelf 20 may be subdivided into a number of individual compartments 22 by vertical dividers 25 carried by the shelves 20. Additionally, as shown in FIG. 2A, horizontal dividers 26, which run perpendicular to the vertical dividers 25, may be provided to divide a shelve 20 into a matrix of small individual compartments 23. The shelves 20 and dividers 25, 26 are individually movable (or removable) so that the height and width of the compartments 22, and the height, width and depth of compartments 23 can be changed as desired to accommodate a variety of items of varying size. Additionally, the shelves may be provided with rollers (not shown) or other types of mechanism well known in the art to allow the shelves to be pulled out like a drawer. The pull-out capability is particularly useful for shelves divided into a matrix of small compartments 23 as shown in FIG. 2A.

Each of the cabinets 12 is enclosed by one or more doors 28 each having a handle 30. Electronically controlled locks (not shown) behind door handles 30 control access to the items housed in the cabinets 12 in response to commands sent from a processor 33. Operation of the processor 33 is described in detail below. Although the processor 33 is optionally carried by one of the cabinets 12, it controls all of the cabinets 12 connected to it. Doors 28, and optionally the sides and tops of the cabinets 12, may be made of transparent material so that the items housed in the cabinets 12 are easily visible.

The number of shelves 20 and the vertical spacing between the shelves can be varied by inserting or removing individual shelves in cabinets 12. Vertical members 34 of cabinets 12 may be provided with ports or openings 35 into which brackets or drawer suspension mechanisms may be inserted for supporting the shelves 20 at variable locations.

Figure 2B:
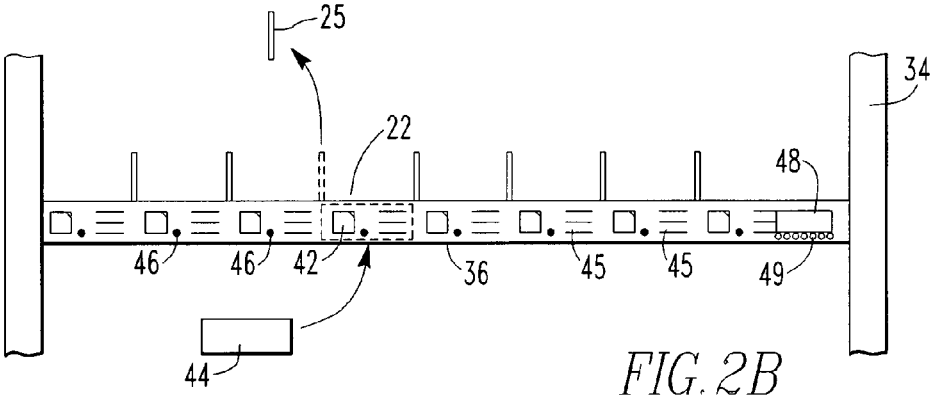

FIG. 2A depicts a switch panel 36, located at the front of a shelf 20, as well as a plurality of removable dividers 25, 26 which define a number of compartments 23 across the width and depth of the shelf. FIG. 2B depicts the switch panel 36, located at the front of a shelf 20, as well as a plurality of removable dividers 25 which define a number of compartments 22 across the width of the shelf. The height of the compartments 22, 23 is defined by the spacing between adjacent shelves 20 as described above. The number, width and depth of the compartments are defined by inserting or removing dividers 25, 26 as depicted in FIGS. 2A and 2B. FIG. 2A depicts a shelf for which dividers 25 have been inserted to define a column of compartments 23 corresponding to each one of a number of individual touch-activated item switches 42 on the front of switch panel 36; FIG. 2B depicts a shelf for which dividers 25 have been inserted to define compartments 22 each corresponding to one of a number of individual touch-activated item switches 42 on the front of switch panel 36.

If one or more wider compartments are desired to accommodate larger items, then one or more of the dividers 25 may be removed from the shelf as depicted in FIG. 2B. An opaque cover 44 may then snapped into place over a corresponding one of the item switches 42 on switch panel 36. In that way, compartments of various widths may be provided with one exposed item switch 42 associated with each individual compartment 22 or column of compartments 23. The positioning of the item switches 42 relative to the dividers 25 is such that, no matter the width of the compartment, the one exposed item switch corresponding to the compartment is below and near one end (the left end in FIG. 2B) of the compartment. Identifying information such as the item name or item number may be written onto labels 45 on the switch panel 36 in close proximity to the item switches 42. Identifying information may also be written on labels on the horizontal and/or vertical dividers.

Touch-activated item switches 42 are used to gather inventory information as items are taken from and restocked into the compartments. Additionally, each item switch 42 has a visual indicator 46 located near it. Visual indicators 46 may be in the form of small light sources, preferably light emitting diodes (LEDs). Finally, each switch panel 36 includes a display 48, which may be an alpha-numeric display, and a keypad, e.g., a series of buttons labeled 1 through 9 and "clear," near one end (the right end in FIGS. 2A and 2B) of the switch panel 36. The operation of the switches 42, visual indicators 46, display 48 and keypad 49 is described in more detail below.

Figure 3:
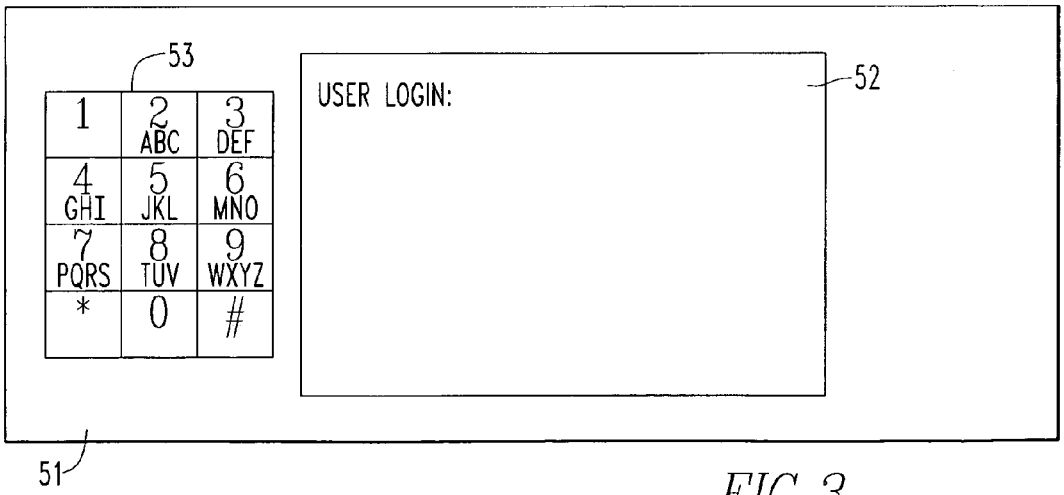
FIG. 3 depicts a front view of the processor of the dispensing unit.

Referring again to FIG. 1, the processor 33 has a front face 51, shown in FIG. 3, including a display panel 52 (which may optionally have a touch screen) and an alpha numeric keypad 53. The display panel 52 will display a variety of different information depending upon the mode of operation selected, e.g. dispense, locate, return, or restock. If a touch-screen display panel is used, the programming of the display panel 52 may be such that the keypad 53 may be eliminated in certain circumstances. Optionally, the processor 33, display panel 52, and keypad 53 may be implemented using a standard PC.

Figure 4:
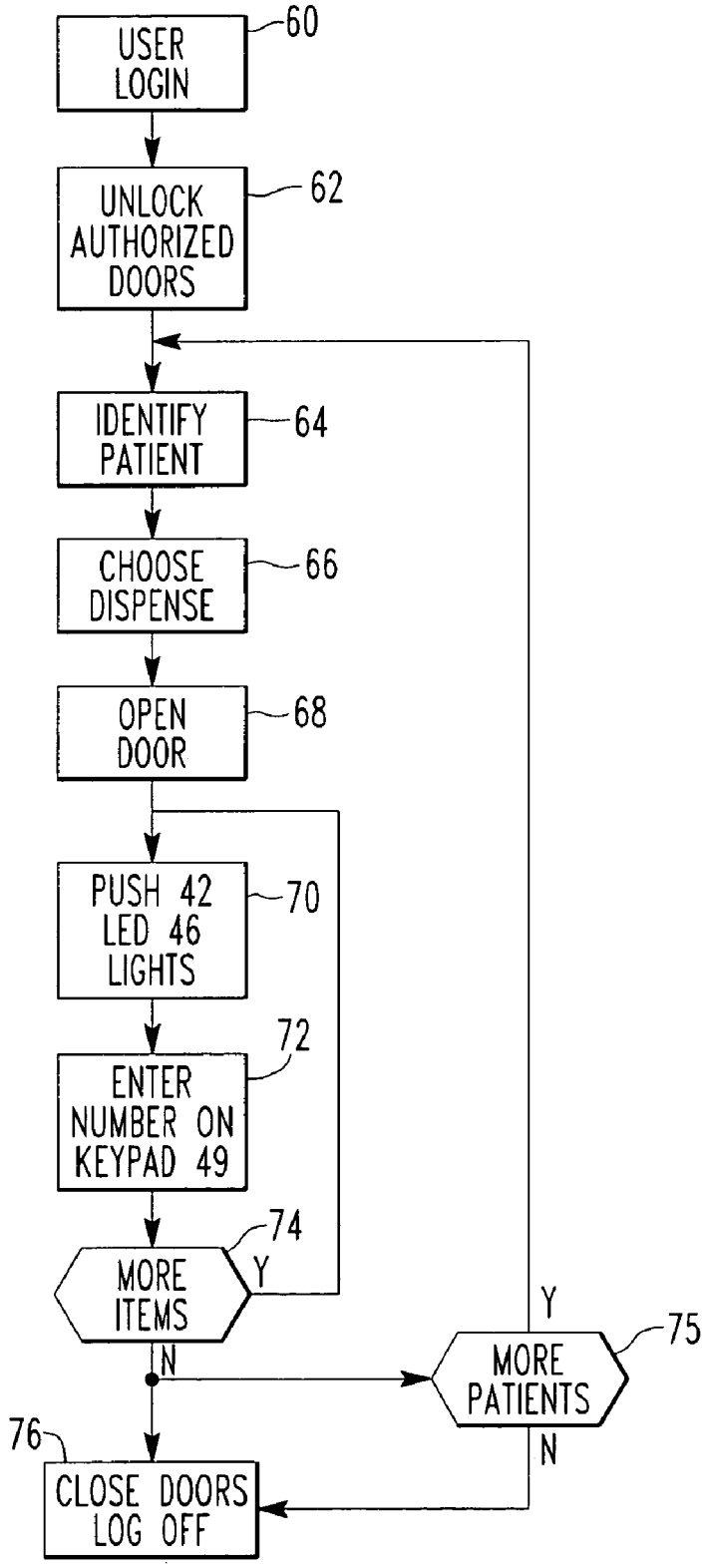
FIG. 4 is a flow chart illustrating the dispensing mode.

A flow-chart illustrating the logic of a dispensing mode performed by the unit 10 is depicted in FIG. 4. In FIG. 4, the process begins at step 60 where the user logs in. Login may be by entry of identification numbers via keypad 53, via electronic data exchange (i.e., barcode scanning, communication with an input device, etc.), or picking items off of a pick list displayed on touch-screen 52. Thus, the manner of entering user information is not important to the present invention.

At step 64 the processor 33, using the user entered data and stored data, determines the level of access to which the user is entitled and unlocks the relevant doors 28. Next, at step 64, the user identifies a patient. Patient identification may be by entry of identification numbers via keypad 53, via electronic data exchange (i.e., barcode scanning, communication with an input device, etc.), or picking items off of a pick list displayed on touch-screen 52. Thus, the manner of entering patient information is not important to the present invention.

At step 66, the user chooses a mode of operation. In FIG. 4, it is assumed that the user has chosen the dispense mode.

After choosing the dispense mode of operation, at step 68, the user opens those doors 28 which have been unlocked and behind which items are located which the user desires. At step 70, the user pushes the touch activated switch 42 associated with the compartment 22 containing the item to be dispensed. At the time that touch activated switch 42 is activated, the visual indicator 46 associated with that switch is lit.

In the event that the drawer is divided into a matrix of compartments 23, activation of the touch activated switch 42 will identify a column of compartments 23. Thereafter, the user may use the keypad 49 to identify the appropriate compartment 23 within the column.

After the appropriate compartment has been identified, the user will use keypad 49 to identify the quantity of items taken. For example, if three items are to be taken, the push button for the number "3" will be pushed. That will cause the number "3" to be illuminated on alpha numeric display 48. Thereafter, at step 74, additional items may be taken from the same or a different shelf. If no more items are needed, the user may close the door at step 76 and return to the computer 33 to log off or, as shown by step 75, may return to step 64 to identify another patient for whom a dispense operation is desired. At log off, the transaction is saved and records within processor 33 are reconciled to reflect the items, and quantity of each item, that were dispensed.

Figure 5:
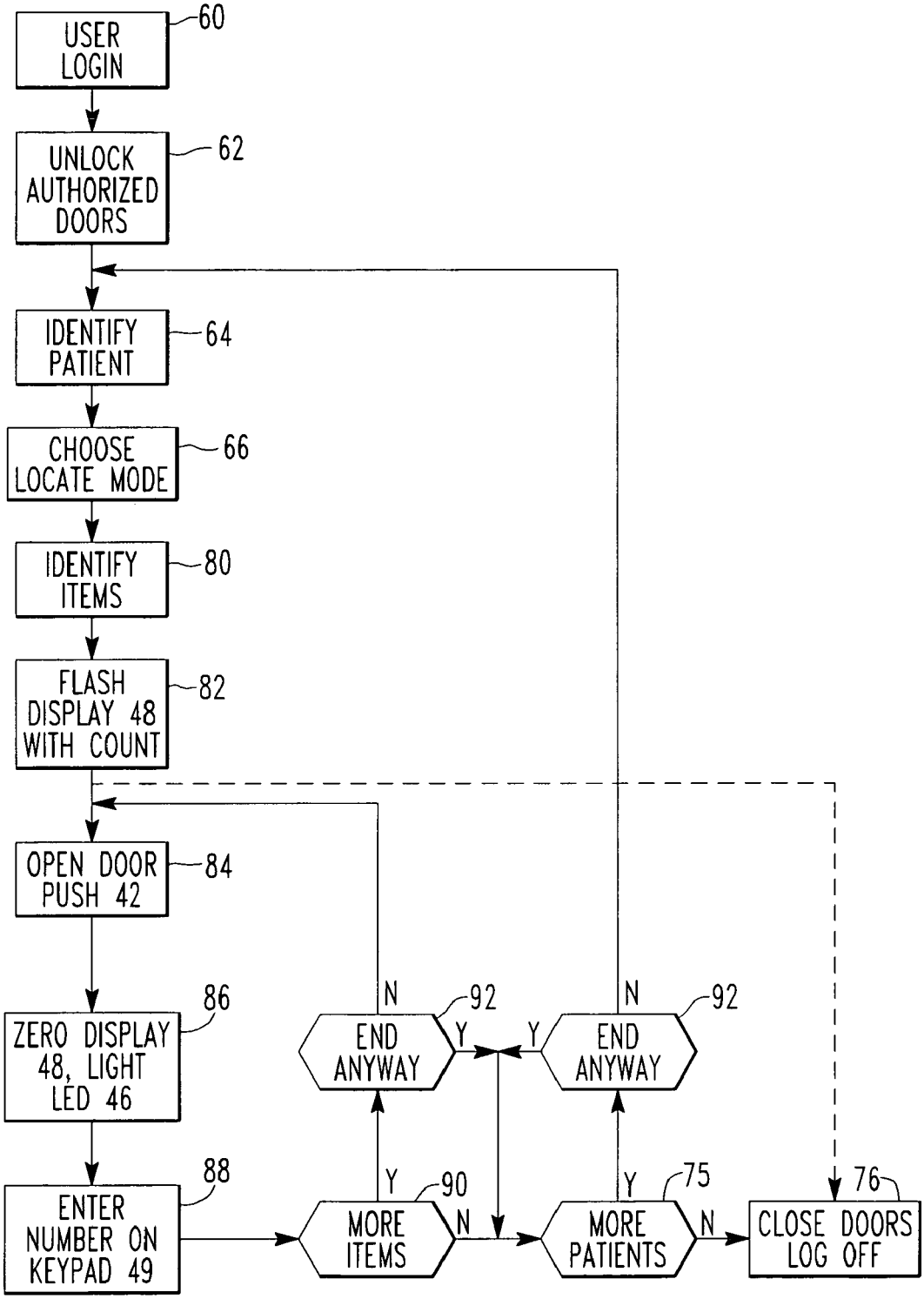
FIG. 5 is a flow chart illustrating the locate mode.

FIG. 5 is a flowchart illustrating the locate mode of operation. Step 60, 62 and 64 are the same as previously discussed in conjunction with FIG. 4. However, at step 66, it is assumed in FIG. 5 that the user chooses the locate mode.

At step 80, the user then identifies items to be located. These items will preferable be selected from a pick list, but could be entered using the keypad 53, scanning a barcode from an inventory list, or other manner of input. The processor, using the user entered information and stored information, determines where the item, or items are located.

At step 82, the processor 33 causes the display 48 on each self 20 which contains an item to be located to flash. If one item is located on that shelf, the alpha numeric display 48 flashes the number "1". If two items are located, the display flashes the number "2", etc. At this point, the user may simply close any doors that may have been opened and log off as shown by the dotted line leading to step 76. The user may use the locate mode to ensure that items which will be needed later are stocked in the unit 10. However, after locating the item, the user may decide that the item is to be dispensed. In that case, the process proceeds with step 84.

At step 84, the user opens the door in front of a shelf 20 having a flashing display 48. The user locates the item to be dispensed on the shelf, and pushes the touch activated switch 42 for that compartment 22. In the case of a matrix of compartments 23, the touch activated switch 42 for the column of compartments 23 is activated, and the user uses the keypad 49 to select the particular compartment 23. When the compartment has been selected, the alpha numeric display 48 stops flashing and is reset to "0". The visual indicator 46 associated with the selected compartment 23 is lit as indicated by step 86.

At step 88, the quantity of items to be dispensed is removed and entered on keypad 49. The quantity entered on keypad 49 will be shown on display 48. If the user selects an item for which a quantity has already been entered (i.e. through keypad 53 on processor 33), the alpha-numeric display 48 displays the previously entered quantity. If the user now presses another number on the keypad 49, the alpha-numeric display 48 will display the sum of the previously displayed quantity plus the new number pressed and a signal sent to the processor 33 to set the quantity appropriately. That functionality means that you cannot enter a two digit number the second time around. If no more items are to be selected as shown by decision step 90, and if no more patients are to be dispensed for as shown by the decision step 75, the user logs off at step 76 which is the same log off procedure as in FIG. 4. If more items are to be located or if there are more patients for which a dispense is desired, the user can still decide not remove any more items at decision steps 92. In either case, the user may proceed to close the doors and log off as shown by step 76.

The operation of the "clear" button, which may be part of keypad 49 is as follows:

- If the user presses the clear button when the alpha-numeric display 48 is flashing the number of items found on a shelf, the alpha-numeric display 48 is extinguished and the shelf operates as if it were in a simple dispense mode.
- If the user presses the clear button after selecting an item by pushing the touch sensitive switch 42 for a compartment 22 but not entering anything on the keypad 49, then the alpha-numeric display 48 would extinguish as if no item had been selected.
- If the user presses the clear button after selecting an item and a quantity is selected, the alpha-numeric display 48 would go to zero and a signal sent to the processor to set the quantity to zero.
- If the user reselects an item for which a quantity had already been entered, the alpha-numeric display 48 displays the previously entered quantity; if the user now presses the clear button, the alpha-numeric display 48 would go to zero and a signal sent to the processor to set the quantity to zero (exactly as if it had been the most recently entered item and quantity).

Figure 6:
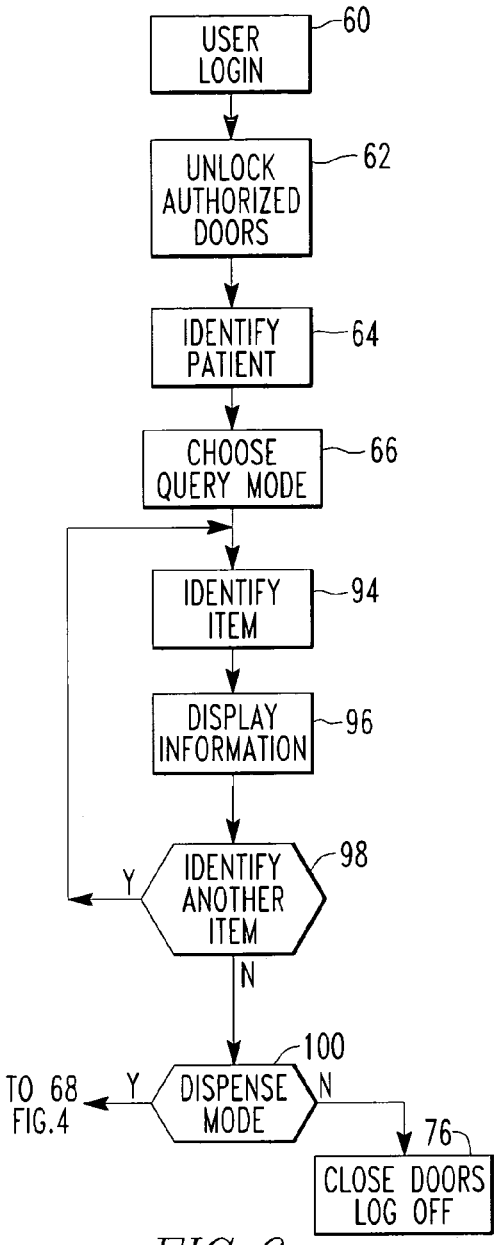
FIG. 6 is a flow chart illustrating the query mode.

Turning to FIG. 6, FIG. 6 is a flow chart illustrating the query mode. The query mode starts off the same as the other modes with the user login at step 60, the unlocking of doors at step 62 to provide access to items which the user has authority to remove and, the identification of a patient at step 64. At step 66, it is assumed that the query mode is selected. Thereafter, at step 94, an item is identified. The item may be selected from a pick list, but could be entered using the keypad 53, scanning a bar code from an inventory list, or other manner of input. The processor 33 then displays information about the identified item at step 96.

Figure 7:
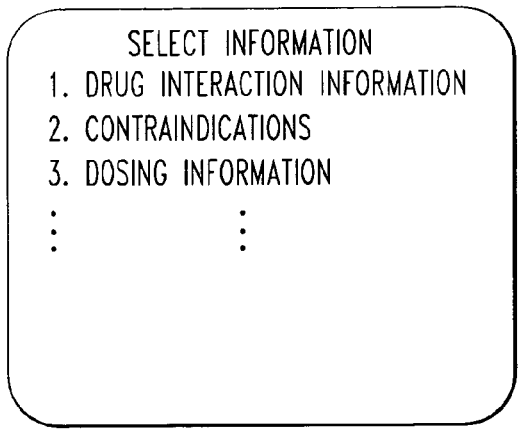
FIGS. 7 and 8 illustrate screens which may be used in conjunction with the query mode.
Figure 8:
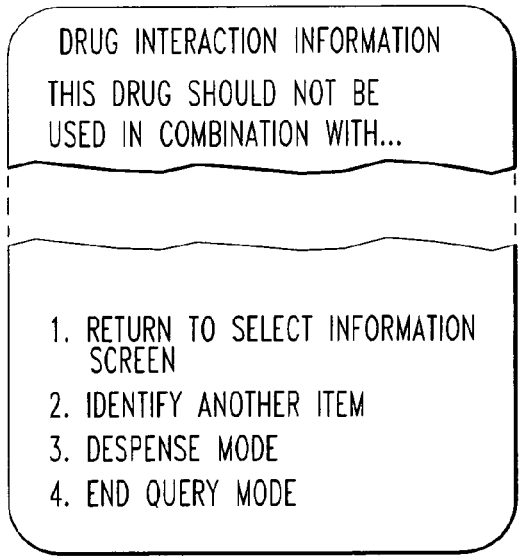

FIG. 7 is a screen shot of the display 52, for example, for a medication. It may be that for certain items, such as medications, there are numerous types of information which can be provided, such as drug interaction information, contraindications, typical dosing information, etc. In those cases, the user would select the desired information using the keypad 53 or, in the case of a touch sensitive screen 52, the touch screen. The processor 33 would then display the selected information. For example, assuming in FIG. 7 that drug interaction information, selection 1, was selected, a screen shot of the information that might be shown is illustrated in FIG. 8. After the drug interaction information, the user may be provided with options such as (1)—return to "select information screen," (2)—choose another item, (3)—dispense mode or (4)—end query mode.

If selection 1 is chosen, the user would be returned to the screen shown in FIG. 7 so that the user could select additional information to be displayed. If there were only one screen of information to be displayed, then the options of returning to the "select information screen," identifying another item, dispense mode and end query mode would appear at the end of that screen.

Assuming that in FIG. 8 option 2—identifying another item—is selected. As a result, in step 98 the process returns to step 94. If option 3—dispense mode—is chosen, then in step 100 the process flow continues with step 68 in FIG. 4, which is the normal dispense mode. If the "end query mode" is selected, i.e., another item is not identified and the dispense mode is not to be entered, then the doors are closed and the user logs off as shown by step 76.

The present invention provides the advantage of a flashing alpha-numeric display on each shelf containing at least one item which is to be located. Furthermore, the display flashes the number of items to be located which are on that shelf. Thereafter, it is a straightforward matter for the user to identify the appropriate compartment from the limited number of compartments carried by that shelf. Furthermore, the locate mode of the present invention enables a user to end the locate mode and enter the dispense mode. The dispense mode which is entered is the same as the normal dispense mode so that users need not learn different methods of dispensing based on how the dispense mode was entered. The query mode provides the user with access to valuable information in a convenient manner. The normal dispense mode can be entered from the query mode so that once a user understands how to operate the dispense mode, that mode is the same no matter how it is entered.

Although units 10 of the type disclosed are also capable of operating in restock and return modes, those modes of operation do not form a feature of the present invention and therefore are not disclosed. The aforementioned prior art discloses a number of return and restock modes and the reader is directed to those prior art patents if more information is desired regarding those modes of operation.

In preferred embodiments, the processor 33 is electronically connected to the hospital's central record keeping system and the pharmacy and/or materials management systems. From time to time, the records corresponding to items taken from the unit are sent to the central record keeping system for billing purposes while the same information may be sent to the pharmacy and/or materials management for restocking and reordering purposes. In the preferred embodiments, the modes of operation are carried out under the control of the processor 33 executing software instructions stored in any suitable manner, e.g., storage devices such as a hard drive (102 in FIG. 1), floppy disk, etc. Additionally, certain instructions or information may be stored in a location remote from processor 33 location, which is accessed via a communication link (not shown).

The invention has been described in considerable detail for purposes of facilitating its understanding. However, alternative uses for the invention will occur to those skilled in the art. In particular, although the invention has been described as being especially useful for dispensing medications and medical supplies, the invention may be used advantageously in other settings as well. Furthermore, modifications and improvements may be made without departing from the scope and spirit of the invention. Therefore, the above description should not be taken as limiting the scope of the invention. Instead, the scope of the invention should be determined with reference to the appended claims, along with the full scope of equivalents to which those claims may be entitled.

What is claimed is:

1. A memory device carrying a set of instructions which, when executed, perform a method comprising:

receiving user information;

unlocking certain doors of a dispensing cabinet in response to said user information;

receiving patient information;

receiving mode information identifying a locate mode;

receiving a list at containing least one item to be located;

flashing a display positioned one shelf within the cabinet with the number of different variety of items on the list held by that shelf;

receiving information selecting a compartment; and zeroing the display in response to the selection of a compartment.

2. The memory device of claim 1 additionally comprising:

receiving the number of items taken from the selected compartment;

displaying the number of items taken on the display;

receiving a log off instruction; and locking the unlocked doors.

3. A memory device carrying a set of instructions which, when executed, perform a method comprising:

receiving user information;

receiving mode information identifying a locate mode;

receiving information identifying a list containing at least one item to be located; and indicating on a numeric display positioned on a shelf within a cabinet the number of different variety of items on the list held by that shelf.

4. The memory device of claim 3 additionally comprising receiving patient information.

5. The memory device of claim 3 additionally comprising unlocking certain doors of the cabinet in response to said user information.

6. The memory device of claim 5 additionally comprising receiving a log off instruction and locking the unlocked doors in response to the receipt of said log off instruction.

7. The memory device of claim 3 wherein said indicating includes flashing the number of different items on the numeric display.

* * * * *